US006227417B1

(12) United States Patent
De LaForcade et al.

(10) Patent No.: US 6,227,417 B1
(45) Date of Patent: May 8, 2001

(54) PRESSURIZED DEVICE

(75) Inventors: Vincent De LaForcade, Rambouillet; Frank Lacout, Draveil, both of (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/361,307

(22) Filed: Jul. 27, 1999

Related U.S. Application Data

(62) Division of application No. 08/748,918, filed on Nov. 13, 1996, now Pat. No. 5,988,453.

(30) Foreign Application Priority Data

| | | |
|---|---|---|
| Nov. 13, 1995 | (FR) | 95-13412 |
| May 13, 1996 | (FR) | 96-05918 |
| Jul. 31, 1996 | (FR) | 96-09651 |

(51) Int. Cl.[7] ..... B65D 88/54
(52) U.S. Cl. ..... 222/321.9; 222/402.1
(58) Field of Search ..... 222/321.9, 402.1

(56) References Cited

U.S. PATENT DOCUMENTS

| | | | |
|---|---|---|---|
| 2,765,965 | | 10/1956 | Reswick . |
| 3,099,370 | | 7/1963 | Hein . |
| 3,122,284 | | 2/1964 | Miles . |
| 3,233,791 | | 2/1966 | Miles . |
| 3,327,907 | | 6/1967 | Meyers . |
| 3,659,395 | | 5/1972 | Morane et al. . |
| 4,795,063 | | 1/1989 | Sekiguchi et al. . |
| 5,988,453 | * | 11/1999 | De Laforcade et al. ..... 222/321.9 |

FOREIGN PATENT DOCUMENTS

| | | |
|---|---|---|
| 333 889 | 5/1926 | (BE) . |
| 1 186 808 | 2/1965 | (DE) . |
| 2 009 922 | 12/1970 | (DE) . |
| 0 024 263 | 8/1980 | (EP) . |
| 0 030 990 | 7/1981 | (EP) . |
| 0 248 755 | 12/1987 | (EP) . |
| 2 311 723 | 12/1976 | (FR) . |
| 48-24443 | 7/1973 | (JP) . |
| 59-19017 | 2/1984 | (JP) . |
| 62-134880 | 8/1987 | (JP) . |
| 2-150058 | 12/1990 | (JP) . |
| 3-15663 | 2/1991 | (JP) . |
| WO 93/10826 | 6/1993 | (WO) . |

OTHER PUBLICATIONS

English language abstract of EP 0 030 990, published Jul. 1, 1981.
English language abstract of EP 0 024 263, published Feb. 25, 1981.
English language abstract of EP 0 248 755, published Dec. 9, 1987.

* cited by examiner

*Primary Examiner*—Philippe Derakshani
(74) *Attorney, Agent, or Firm*—Finnegan, Henderson, Farabow, Garrett & Dunner, L.L.P.

(57) ABSTRACT

A pressurized container, containing a dished part and a valve equipped with a valve body with a valve-control stem surmounted by a push-button with a seal and with a return system wherein the dished part and the valve body interact to form, on the one hand, a reservoir cavity able to contain a product to be dispensed and a propulsion device and, on the other hand, a valve cavity and wherein a passage is formed between the reservoir cavity and the valve cavity.

120 Claims, 11 Drawing Sheets

PRESSURIZED DEVICE

This application is a division of application No. 08/748,918 filed Nov. 13, 1996 U.S. Pat. No. 5,988,453.

BACKGROUND OF THE INVENTION

1. Field of the Invention

The present invention relates to a pressurized container, the body of which contains an assembly of a valve body and of a dished valve-holder part.

2. Description of the Background

Products intended for mass consumption, particularly cosmetic products, are promoted through distribution of free samplers or trial amounts thereof. The sampler must resemble the product on sale as closely as possible, with respect to the formula, the scent, the texture, the galenic form, the packaging, and the outer packaging. For reasons of economy, manufacturers continually seek to produce samplers containing the smallest possible amount of product. Of course, the packaging of cosmetic products in single doses is attractive for travel, as this type of packaging uses very little luggage space.

Although it is known to prepare product packagings for products distribution in pressurized containers, in a small size complying with the original formula, the economic criterion which the sample must also satisfy is presently not being met. This is because even a small pressurized container requires a certain number of indispensable elements in order to function, namely:

- a container body, which is a can made of tin plate or aluminum, and on whose walls a lacquer is deposited,
- a valve crimped on the neck of the container body via a dished valve-holder part,
- and a dispensing means connected to the valve.

Conventional techniques for manufacturing pressurized cans do not afford cans which are small enough to correspond to the volume of a trial dose, which is approximately 3.5 ml to 8 ml. This is because the work of crimping the metal, i.e. crimping the valve-holder dished part on to the container body, on the one hand, and around the valve, on the other hand, which consists in forcing the metal to adopt a desired configuration, in particular to grip on to the valve, is work which can be done only on parts which are sufficiently large. This manufacturing constraint, therefore, dictates the minimum size of the dished valve-holder part, and, hence, the volume of the can which is necessarily greater than a one-use dose.

Furthermore, the operations for fashioning the can are expensive, as is the incorporation of a valve into the can. Unfortunately, this valve is one of the elements which are indispensable to the operation of the pressurized container.

In order to solve this problem, use of a can made of a thermoplastic instead of metal has been envisaged. However, this approach is also very expensive since the high internal pressure caused by the gaseous propellant necessitates the use of very thick plastic in order impart sufficient rigidity. On the other hand, the crimping of the valve to the neck of the can requires this neck, and this valve, to have a special shape. It is, therefore, necessary to use a valve which is designed for external crimping, and which is, therefore, more expensive than a standard valve. External crimping has to be carried out on a perfectly even surface, which is to say a surface with no trace of parting line or mould release line. Thus, the cans must be manufactured by an injection blow-molding technique, which is expensive when a large number of units are produced.

Conventional pressurized devices consist of a container body on which a cap may be fitted; crimped to the neck of this container by means of a dished valve-holder part is a valve; a dispensing means is connected to the valve; the container body and the dished part define a reservoir cavity; the valve consists of a valve body, of a valve-control stem which passes through the valve body, of a seal, and of a return system which presses the valve-control stem against the seal, with all of the above being held in place by the crimping of the valve-holder dished part; the valve-control stem is surmounted by a push-button. Arranged in the container body are a product to be dispensed and a propulsion means therefor.

The propulsion means may be a compressed gas in direct contact with the product in the container body. In this case, a dip member is fixed to the valve. When it is not desired that the product be in contact with the gas the gas and the product may be separated by a flexible bag or using a piston. When a flexible bag, is used, problems often arise regarding compatibility with the formula and solidity of the material of which the bag is made. The bag must, at once, be flexible and leaktight. When a piston is used for separating the gas from the product, problems are encountered because the seal along the contacting surfaces of the piston and of the internal wall of the container body. Furthermore, in both cases, the gas-filler orifice must be distinct from the one for the formula, i.e. filling with gas often takes place through an orifice situated at the bottom of the container and which is then closed off by a rubber bung. This configuration implies repeated operations during manufacture, namely opening the gas-filler orifice, installing the bag or the piston, and fitting the bung. It is also expensive because of the complexity of the filling process, i.e. requiring filling first with product and then with gas.

EP-A-0561292 discloses dispensing devices using, as propulsion means, a closed-cell cellular material. A gas is held captive in the cells of the cellular material. This document describes a device in which the product is placed in a flexible bottle, inside the container body. The cellular material is placed in this container body in contact with and on the outside of the flexible bottle. The cellular material is connected to a thumb wheel. Before the valve is actuated using a push-button, energy must be stored in the cellular material by actuating a thumb wheel. The gas contained in the cellular material is then placed under mechanical pressure and this pressure is transmitted to the bottle and to its contents. Thus, by actuating the valve, the product can then be dispensed.

However, such a device has numerous drawbacks. For example, this device has a large number of component parts, which component parts require a very fine compatibility (screw threads, leaktightness) and are, moreover, sophisticated. Consequently, such a device is quite very expensive. The storage of energy by mechanical compression of the cellular material takes place in small quantities and the user must turn a thumb wheel in order to store up the energy corresponding to approximately one dose before actuating the push-button. The required two-part action makes the device complicated and not very attractive for consumers with little available time. The bottle in which the product is contained has the shape of a bellows and so, even if it is compressed as much as possible under the action of the cellular material, such a bottle cannot be completely emptied and a low restitution ratio will be obtained.

When energy is stored in the element made of cellular material by turning the thumb wheel, a strong osmotic pressure is created across the wall of the bottle. Thus, the wall of this bottle, subjected to an alternating movement through the mechanical action of the cellular material, is weakened by excessively frequent use. The same problem of compatibility of the product with the wall of the bottle is encountered with this device as is encountered in the case where use is made of a flexible bag for separating a gas from the product. Furthermore, if the user inadvertently exerts too strong an action on the thumb wheel, the cellular material will be subjected to a pressure which causes the cells containing the gas to burst and will irreversibly damage the device. Finally, such a device does not allow the bottle to be filled with product through the valve, pressurizing the cellular material, because this mechanical compression will also result in a bursting of the cells, rendering the device unusable.

SUMMARY OF THE INVENTION

Accordingly, it is an object of the present invention to provide a pressurized device in which the gaseous propellant and product are separated, which overcomes the drawbacks of conventional pressurized devices.

This object and others are provided by a pressurized container, containing a dished portion, a valve equipped with a valve body, with a valve-control system surmounted by push-button means with seal and with a return system, wherein the dished part and valve body interact to form, on the one hand, a reservoir cavity able to contain a product to be dispersed and a propulsion means, and a valve cavity, and wherein a passage is formed between the reservoir cavity and the valve cavity.

For simplificity, neither the push-button nor the cap of the containers of FIGS. 5 to 8C have been represented.

Figure 9B:
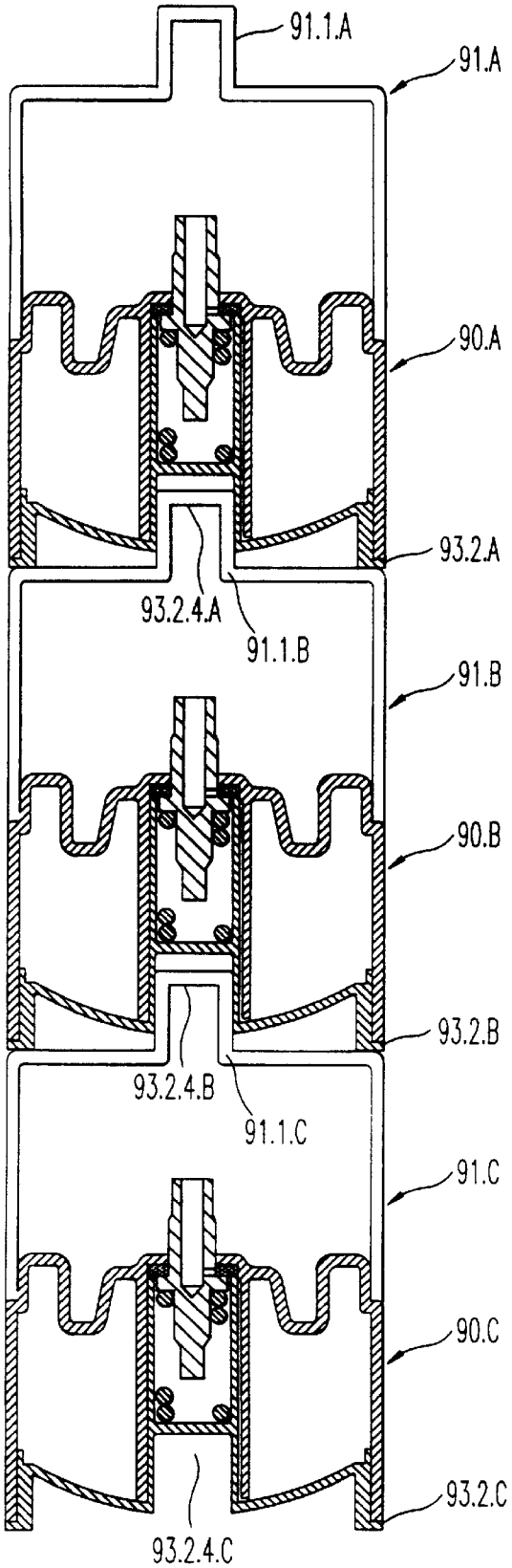
Figure 9A:
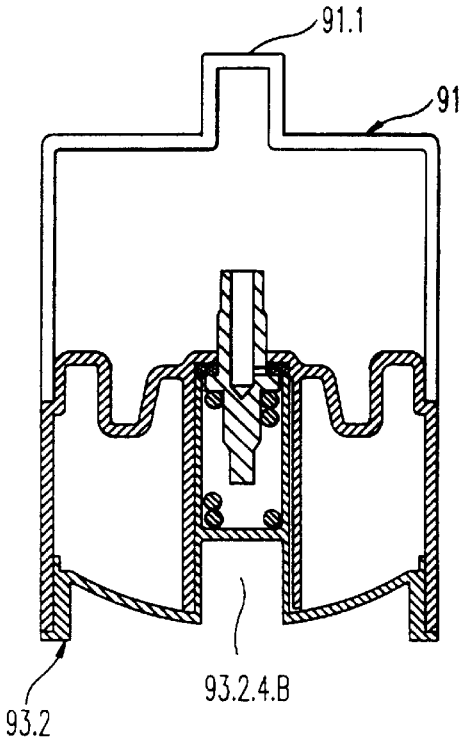

FIGS. 9A and 9B are views in longitudinal section of an alternative form of a pressurized container according to the present invention and of a set of pressurized containers, according to this alternative form, assembled. In FIGS. 9A and 9B, the push-buttons are not represented in order to make the figures easier to understand.

Figure 10A:
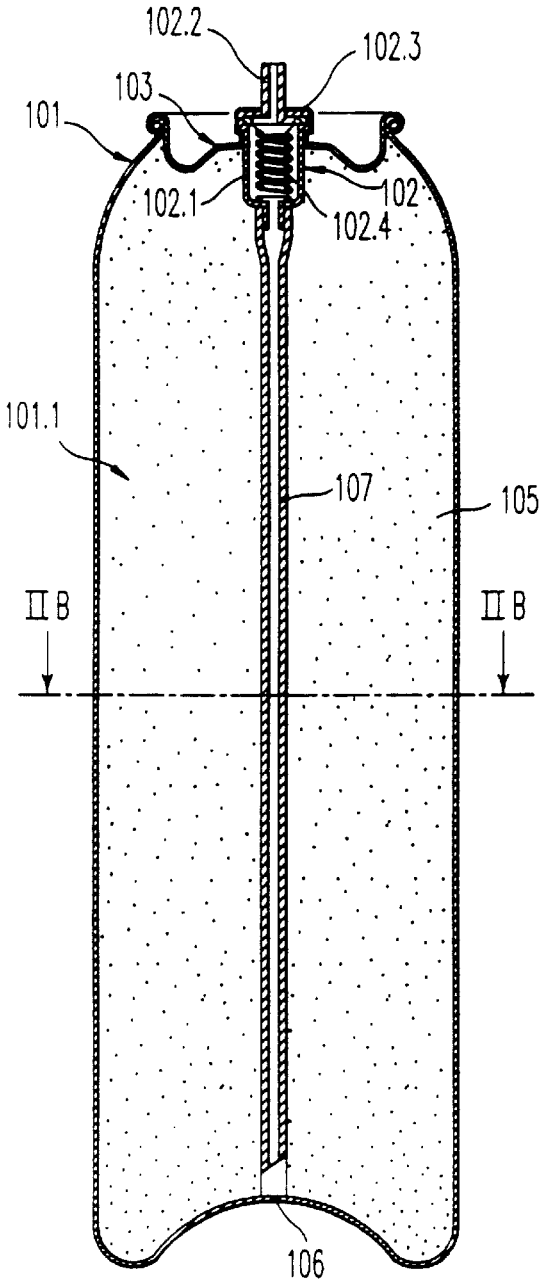
Figure 10B:
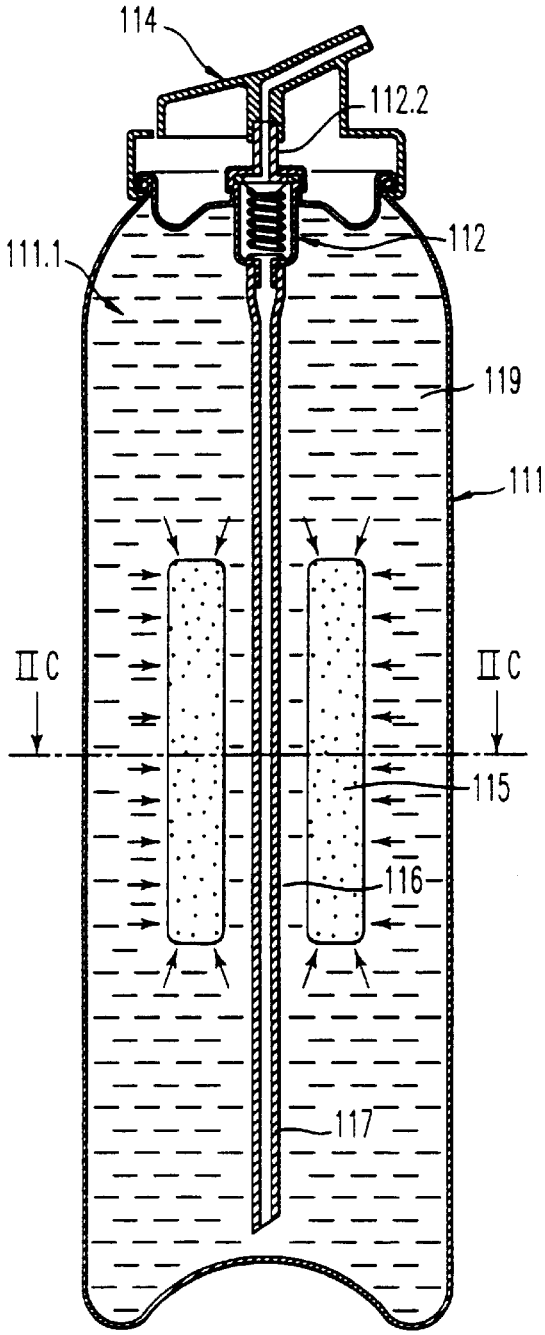

FIGS. 10A and 10B show, in longitudinal section, a pressurized device according to an alternative form of the present invention including a cylinder made of closed-cell cellular material as a propulsion means, this device being equipped with a dip member.

Figure 11A:
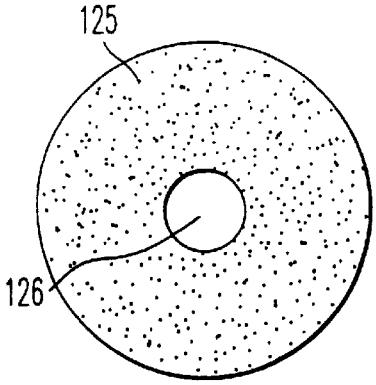
Figure 12A:
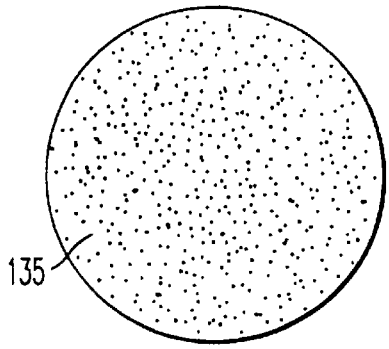

FIGS. 11A and 12A represent a cylinder of cellular material used in the present invention, in transverse section, before it is inserted into the reservoir cavity.

Figure 11B:
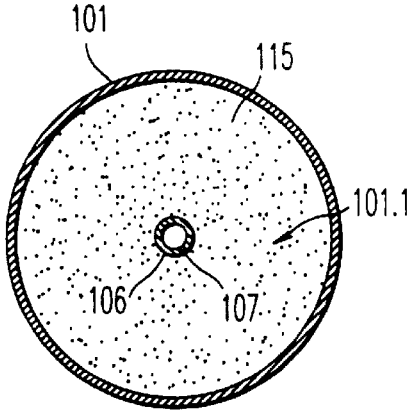
Figure 11C:
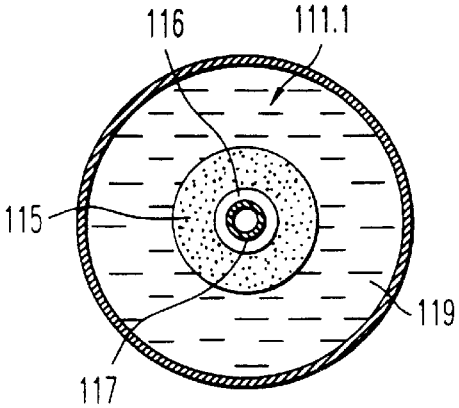

FIGS. 11B, 11C, 12B and 12C represent two alternative forms of pressurized device according to the present invention in transverse section. FIGS. 11B and 11C are transverse sections on the plane II—II of the device represented respectively in FIGS. 10A and 10B.

DETAILED DESCRIPTION OF THE PREFERRED EMBODIMENTS

The present invention first provides a pressurized container containing a dished part, a valve equipped with a valve body, with a valve-control stem surmounted by a push-button possibly including a diffusing means, with a seal and with a return system, the dished part and the valve body interacting to form, on the one hand, a reservoir cavity able to contain a product to be dispensed and a propulsion means and, on the other hand, a valve cavity, a passage being formed between the reservoir cavity and the valve cavity.

According to the present invention, the dished part and the valve body interact in a leaktight manner at their ends to form the container body. For example, the dished part and the valve body comprise complementary fastening elements, for example means which can snap-fit together or complementary profiles which, once assembled, are welded together by any means known to those skilled in the art such as, for example, spin welding or bonding. The fastening elements may also consist of complementary screw threads so that the valve body and the dished part can be screwed together in a leaktight manner.

In order to achieve this interaction, it is possible to choose a valve body which has, on its circumference, said fastening elements and a dished part comprising an outer skirt which, has at its end said fastening elements which complement those of the valve body; this interaction defines the body of the can. It is also possible to choose a dished part which has on its circumference fastening elements, and a valve body comprising an outer skirt which has at its end fastening elements which complement those of the dished part. It is also possible to employ a dished part and a valve body each comprising an outer skirt, the two skirts comprising complementary fastening elements.

According to the present invention, the valve body and the dished part interact to define a valve cavity. Preferably, the valve body and possibly the dished part each comprise an inner skirt. Advantageously, the inner skirts of the valve body and of the dished part fit one inside the other over all or part of their height to delimit the valve cavity. Preferably, the inside diameter of the inner skirt of the dished part is substantially equal to the outside diameter of the inner skirt of the valve body.

The upper surface of the inner skirt of the valve body advantageously presses on the seal, pressing it against the rim of the dished part which encircles the passage for the valve-control stem. The valve is, therefore, leaktight.

According to the present invention, a passage is formed between the reservoir cavity and the valve. In a preferred way, the inner skirts of the dished part and of the valve body each include at least one notch, these notches being associated with a circular chamfer of one or other of the skirts, along the perimeter of the contacting surface of the skirts and possibly with a groove along the entire height of the contacting surface of the skirts, all of these cutouts (groove, chamfer, notches) defining the passage for the product, and possibly the gas, between the reservoir cavity and the valve cavity.

The containers according to the present invention make it possible to dispense different types of products, such as lotions, creams, foams and milks. Depending on whether the product to be dispensed is in the form of a continuous phase (cream, milk) or in a discontinuous form (foam, spray), the container according to the present invention is adapted so that the gas and the product are separated or, in the latter case, mixed in a single reservoir cavity. When it is desired that the gas be separated from the product, a reservoir cavity is provided which consists of two sealed cavities, one containing the product and the other the gas, the wall separating these two cavities being capable of transmitting the pressure of the gas from one cavity to the other. The wall between the two cavities may be rigid, for example as a piston, or flexible, for example such as a flexible bag, a bellows or an element made of cellular material.

Advantageously, the valve body and the dished part are made of thermoplastic. These two elements may consist of the same material or of two different materials which are chemically compatible so that they can be welded together or of two materials which are chemically incompatible and are assembled by screwing, bonding or snap-fitting. Among the materials that can be used in the present invention, mention may, for example, be made of the polyolefin family, such as polypropylene, polyethylene, and ethylene and propylene copolymers, the polyacetyl family, such as polyoxyethylene; it is also possible to employ polyethylene terephthalate, polymethylmethacrylate.

The polymer used in the present invention may contain fillers for example such as silica, glass fibers, carbon fibers. It is also possible to envisage manufacturing these elements from other materials, for example such as metal or glass.

The wall thicknesses of the dished part and of the valve holder and especially of their skirts are adapted by those skilled in the art to withstand the pressure of the gaseous propellant.

The valve-control stem may be of any type known to those skilled in the art, such as an emerging stem or a female stem by way of example; this may be one that moves axially or laterally, the latter type of valve also being known as a tilt valve.

The return means may, in a manner known per se, be a spring or any compressible or elastically deformable material that can be housed in the valve cavity.

As an option, the dished part may comprise a circular channel. The existence of this channel makes it possible to use a push-button of standard format which is positioned in the channel. Furthermore, this channel gives greater strength to the dished part.

The containers according to the present invention are particularly advantageous when they are made in the form of aerosol containers for sampling one to a few doses of a product, as they are the type of packaging which is needed to satisfy the economic requirements of the market. Despite this novelty, however, their use is not in any way limited only to the dispensing of samples as the present containers present invention may be produced in formats of all sizes, for which those skilled in the art know how to adapt the nature and thickness of the material to give the container the necessary strength.

Another aspect of the present invention provides a set of pressurized containers including several containers as described hereinabove, each container including a cavity in the bottom of its valve body and a complementary cylindrical stud situated on the cap of this container. This stud and cavity allow at least two containers to be secured together by fitting the stud of the first in the cavity of the second.

Yet another aspect of the present invention entails a pressurized device for dispensing a product containing a reservoir cavity, a valve placed at the top of the reservoir cavity, a dispensing means connected to the valve and a pressurizing means, wherein the pressurizing means consists of an element made of closed-cell cellular material, the element made of cellular material and the product being placed in the reservoir cavity and subjected to a permanent and uniform pressure so that the device dispenses the product when the valve is actuated. As used herein, the term "uniform pressure" means that the pressure is the same at any place inside of the reservoir cavity.

Such a device makes it possible to avoid the gas mixing with the product to be dispensed and to avoid leakage of gas. Thus, the duration for which the device can be used is prolonged. Depending on the nature of the cellular material and the size of the element made of cellular material, the pressure inside the device can be adapted to suit the viscosity of the product to be dispensed. Such a device allows a product to be pressurized without the risk of the product being contaminated by the gas and without contaminating the atmosphere. Furthermore, this device has only a small number of mechanical components which are in widespread use and is simple to manufacture; it is, therefore, not very expensive, and it is simple to use. The device is sturdy and carries no risk of the cell rupture through inept use. Finally, the compression means is held inside the device after complete dispensation of the product, and this device can, consequently, be reused several times provided it is refilled with product. With such a device, savings accrue on the cost of packaging and its possible reprocessing.

A cellular material that can be used in the present invention consists of a multitude of cells filled with gas which are included within a deformable matrix, such as, for example, a foam made of polyolefin, of elastomer or of any type of thermoplastic, or of rubber, of Buna, of neoprene, of silicone or any other material. The gas may be any gas whatsoever that is compressible or liquefiable at the service pressures, for example, nitrogen or air.

When the cellular material is compressed, the cells are as well, and, thus, a reserve of energy is stored in order to pressurize the product. When the valve of the pressurized device is actuated, the cells expand and dispensing of product takes place.

The gas present in the cells is contained therein and cannot escape therefrom. Thus, problems of leaks and mixing with the product are avoided.

By contrast, with the device described in EP-A-0561292, the cells of the cellular material are never subjected to a mechanical pressure, but to a hydraulic pressure; inside the device the element made of cellular material is in direct contact with the product which is subjected to the same pressure as the gas. In this way the risk of the cell rupture is non-existent. This element made of cellular material can, therefore, be used a great many times.

The element made of cellular material used as a pressurizing means in the devices according to the present invention is advantageously of a shape which complements that of the reservoir cavity, and is preferably of cylindrical overall shape.

The element made of cellular material used in the present invention may be manufactured in a known fashion by extrusion or by cutting from a block of closed-cell cellular material. In order to cut out a cylinder of cellular material, it is necessary to compress it before cutting. With this method, after cutting and decompression, an element made of cellular material is obtained which has slightly concave lateral contours, as described in EP-A-0561292. When such an element is placed in a device according to the present invention, product becomes lodged between the concave face and the walls of the container. Thus, a restitution ratio is obtained which is slightly lower than that which may be obtained with a cylinder which has perfectly straight contours. Furthermore, a cylinder cut out of cellular material has open cells on its contours, whereas an extruded cylinder does not. For this reason it is preferable to use a cylinder made of cellular material obtained by extrusion.

The devices according to the present invention make it advantageously possible to dispense all types of products, such as in the form of solution, emulsion, or of gel: lotions, creams, self-foaming compositions, milks and gels.

Preferably, the element made of cellular material has dimensions (height, diameter) which are larger than those of the reservoir cavity so that when the reservoir cavity is closed, precompression of the element made of cellular material is obtained so as still to have energy available when there is not very much product left in the device.

In a first alternative form the present invention entails pressurized devices for dispensing a product containing a container body, the container body defining the reservoir cavity, a valve containing a valve body distinct from the container body, a dispensing means connected to the valve and a pressurizing means, these devices being characterized in that the pressurizing means consists of an element made of closed-cell cellular material, the element made of cellular material and the product being placed in the reservoir cavity and subjected to a permanent and uniform pressure so that the device dispenses the product when the valve is actuated.

According to this alternative form, the valve may be crimped to the neck of the container, in a known way, via a dished valve-holder part, the container body and the dished part defining the reservoir cavity.

It is similarly easy to equip the present device with a valve made of elastomeric material including snap-fitting means able to interact with the neck of the container body as described in French Patent Application No. 95/14175.

Preferably, the device according to this alternative form is equipped with a push-button connected to the valve. This push-button may include a diffusing means chosen, for example, from a nozzle, a mesh, or a porous dome.

The device according to this alternative form may include a dip tube connected to the valve body.

Another alternative form of the invention relates to a pressurized container as described above comprising a dished part; and a valve equipped with a valve body, with a valve-control stem possibly surmounted by a push-button, possibly including a diffusing means, with a seal and with a return system, the dished part and the valve body interacting to form on the one hand a reservoir cavity able to contain a product to be dispensed and a propulsion means and on the other hand a valve cavity, a passage being formed between the reservoir cavity and the valve cavity, and the propulsion means consisting of an element made of cellular material.

According to this alternative form, the valve body passes through the reservoir cavity over its entire height, and constitutes a dip member.

When the device has a dip member, the piece of cellular material has, through its entire height, a cylindrical central orifice in which the dip member is housed.

When the device does not have a dip member, it may be advantageous to provide a central orifice in the element made of cellular material; this is because when the device is assembled the element made of cellular material is inserted into the reservoir cavity. The element made of cellular material is generally of a height greater than or equal to the height of the reservoir cavity. When the valve is placed at the top of the reservoir cavity, for example when the valve is crimped to the top of the container body whose walls define the reservoir cavity, with the aid of a valve-holder dished part, the valve exerts a mechanical compression on the top of the element made of cellular material. The cells subjected to compression burst, and the element made of cellular material is deformed at its upper part. Product can then become lodged in this deformation. Gas is diffused into the reservoir cavity and mixes with the product. To avoid these drawbacks, there may be formed in the element made of cellular material a central orifice in which the valve can be inserted even when the device has no dip member.

Figure 1:
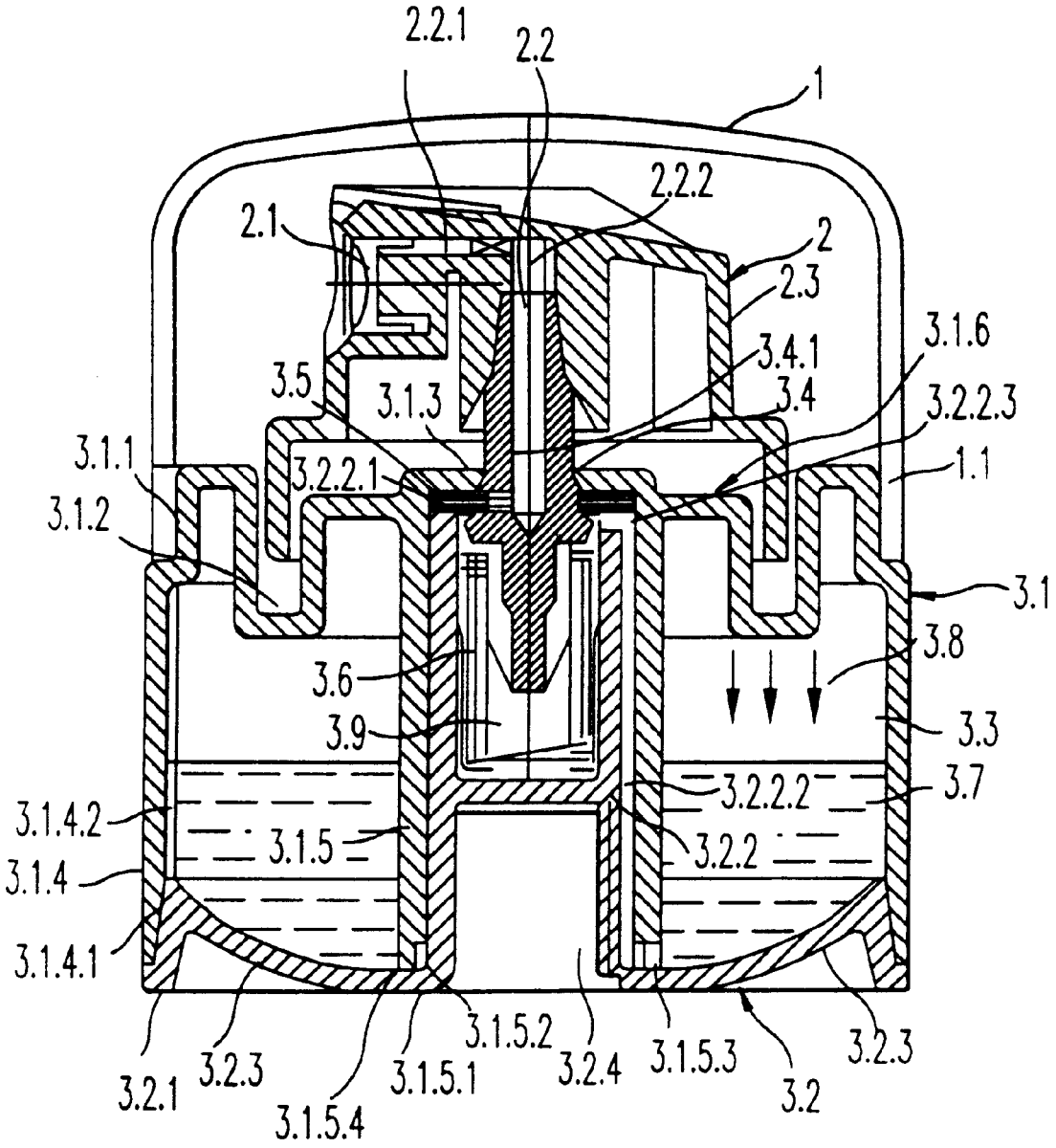
FIG. 1 is a view in longitudinal section of the pressurized container of the present invention.

A pressurized container according to FIG. 1, of cylindrical overall shape, is composed of a cap 1 snap-fastened onto a dished part 3.1. This dished part interacts with the valve body 3.2 to form, on the one hand, an annular cavity 3.3 containing the product 3.7 and the gaseous propellant 3.8, and, on the other hand, the valve cavity 3.9. Inside the latter there are: an emerging valve-control stem 3.4, a seal 3.5 and a spring 3.6 which, with the valve body, constitute the valve proper. The emerging stem 3.4 comprises an outlet orifice 3.4.1 and interacts with a push-button 2.

In this Figure, the seal 3.5 is a component which is independent of the dished part 3.1, but according to an alternative form of the present invention, the seal may be a component integral with the upper plate 3.1.6 of the dished part, made by twin injection of an elastomeric material when the dished part is manufactured, with the same position as the independent seal 3.5.

The push-button consists of a nozzle 2.1 and of a central duct 2.2 including a radial part 2.2.1 and an axial part 2.2.2, the nozzle 2.1 being mounted at the end of the radial part, the emerging stem 3.4 being positioned in the axial part of the duct. The cylindrical external skirt 2.3 of the push-button 2 is elbowed and penetrates a circular channel 3.1.2 on the upper plate 3.1.6 of the dished part 3.1.

Further, at the center of its upper plate 3.1.6, the dished part 3.1 has an orifice 3.1.3 through which the emerging stem 3.4 passes, an outer skirt 3.1.4 and an inner skirt 3.1.5, which are coaxial, the plate 3.1.6 being orientated substantially at right angles to these skirts. In addition, it is possible to add to the internal face of the outer skirt 3.1.4 one or more ribs 3.1.4.2 with the purpose of reinforcing the strength of the wall 3.1.4 with regard to the internal pressure.

The outer skirt 3.1.4 in its bottom part has a profile 3.1.4.1, here in the shape of a chamfer, which is capable of accommodating a complementary profile 3.2.1, which is also chamfered, coming from the valve body 3.2; these two profiles are welded.

The bottom of the valve body 3.2 includes a rounded annular profile 3.2.3 and a cylindrical cavity 3.2.4.

The valve cavity 3.9 is advantageously chosen to have a height suitable to allow a spring 3.6 of standard format to be housed.

The cavity 3.2.4 complements the cavity 3.9 of the valve, it corresponds to the difference in height between the cavity 3.3 and the valve cavity 3.9.

A complementary cylindrical stud situated on the cap 1 of a second container according to the invention fits into the cylindrical cavity 3.2.4 in order to secure at least two containers together (see FIGS. 9A and 9B). Such a possibility for the assembly of the containers according to the invention is particularly judicious, because it makes the storing and handling of these containers easier and allows them to be stowed away in luggage for example, taking up a minimum amount of space and without the risk of them becoming scattered. The containers may contain the same product or products of different natures.

The inner skirt 3.1.5 of the dished part has an inside diameter which corresponds substantially to that of the seal 3.5 and a height which is substantially identical to that of the cavity 3.3. The lower surface 3.1.5.4 of the inner skirt of the dished part is welded to the bottom of the valve body. This weld gives the container as a whole greater strength, particularly greater ability to withstand the pressure of the gas. This welding may be achieved by any means known to those skilled in the art, such as ultrasonic welding, mirror welding, spin welding, bonding. Situated on the internal periphery of the skirt 3.1.5 is a chamfer 3.1.5.2. Furthermore, a notch 3.1.5.3 is made in the internal periphery of the bottom of the skirt 3.1.5; this notch breaks up the continuity of the weld between the internal skirt and the valve body.

The profile 3.2.3 is designed so that the bottom of the valve body has a concave face pointing towards the inside of the cavity 3.3. Thus, when there is little product left, this becomes placed around the internal skirt of the valve body and can be dispensed. This profile makes it possible for the product to be used up better by comparison with a container equipped with a flat bottom. Such a profile also gives the container as a whole a greater ability to withstand pressure.

The valve body 3.2 has the profile 3.2.1 which complements the one already described 3.1.4.1 on its circumference; this profile allows the valve body and the dished part to be centered during assembly and is welded to the part 3.1.4.1 of the dished part. According to an alternative form of the container of the invention, the profiles 3.2.1 and 3.1.4.1 of the valve body and of the dished part respectively may have complementary screw threads so that the valve body and the dished part are screwed together. The two profiles 3.2.1 and 3.1.4.1 can also be designed so that they snap-fit together. The valve body has an inner skirt 3.2.2, the outside diameter of which is substantially equal to the inside diameter of the inner skirt 3.1.5 of the dished part and these two elements are welded. Placed on the upper edge of this skirt 3.2.2 is a sealing ring 3.2.2.1. A groove 3.2.2.2 is provided on the external lateral face of this skirt 3.2.2 over its entire height, and a notch 3.2.2.3 is situated on the upper edge of this skirt. According to an alternative form of the present invention, the groove 3.2.2.2 may just as easily be cut in the interior face of the inner skirt of the dished part.

In order to assemble the pressurized container described in FIG. 1, the spring 3.6 was first of all assembled around the emerging stem 3.4, then the seal 3.5 was placed in the space defined by the inner skirt of the valve body; next, the dished part 3.1 is positioned and welded to the valve body 3.2 at the skirt ends. The pressurized container obtained is leaktight and withstands pressure. In particular, the weld between the inner skirt of the dished part and the bottom of the valve body as well as the circular channel on the dished part strengthen the can.

The pressurized container is then filled through the valve: by depressing the emerging stem 3.4, the orifice 3.4.1 comes clear of the seal, the product, under pressure, fills the first cavity 3.9 defined by the inner skirt of the valve body, passes through the notch 3.2.2.3, runs down along the groove 3.2.2.2, via the chamfer 3.1.5.2 then via the notch 3.1.5.3 and fills the cavity 3.3.

The push-button and the cap are then fitted over on the emerging stem and on the dished part respectively.

When the push-button is depressed, the product follows the reverse path to the one described for filling the can and is atomized as it passes through the nozzle 2.1. This container is designed for head-up use.

In an alternative form of this container, provision may be made for the notch 3.1.5.3 to be placed at the same level as the notch 3.2.2.3, the chamfer 3.1.5.2 also being situated level with the upper edge of the inner skirt of the valve body. According to this alternative form, no groove 3.2.2.2 is provided in the internal skirt 3.2.2 of the valve body. Such a container is used head down. The container according to FIG. 1 is intended for the dispensing of lacquer, hair lotion, scent.

Figure 2:
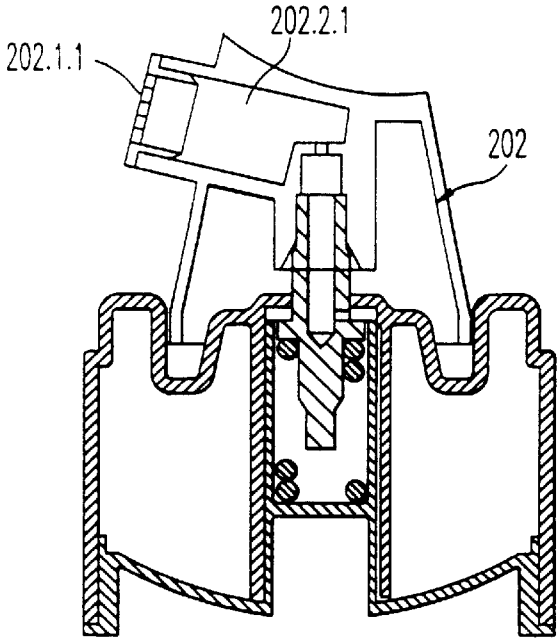
FIGS. 2 and 3 are views in longitudinal section of aerosol cans according to the present invention including dispensing means which differ from those of FIG. 1.

The container represented in FIG. 2 can be distinguished from that represented in FIG. 1 by the presence of a mesh 202.1.1 at the outlet of the radial duct 202.2.1 belonging to the push-button 202, in place of the nozzle 2.1 of FIG. 1. This mesh is more particularly designed for dispensing products in the form of foams, such as shaving foam or hair styling mousse.

Figure 3:
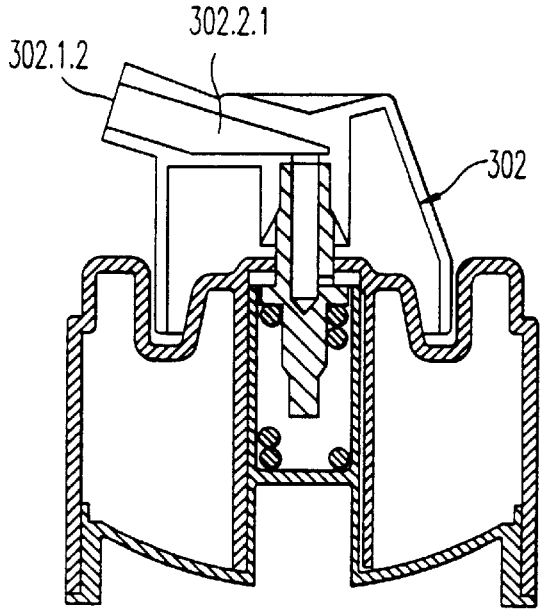

The container represented in FIG. 3 can be distinguished from the two preceding containers by the absence of diffusing means at the end 302.1.2 of the radial duct 302.2.1 of the push-button 302. This container is intended to deliver a toothpaste or a polish.

The two diffusing means of FIGS. 1 and 2 are given by way of example, but any other dispensing means known to those skilled in the art, such as a porous dome like the one described in FR-A-2713060 for example, may be fitted to the containers of the present invention.

Figure 4:
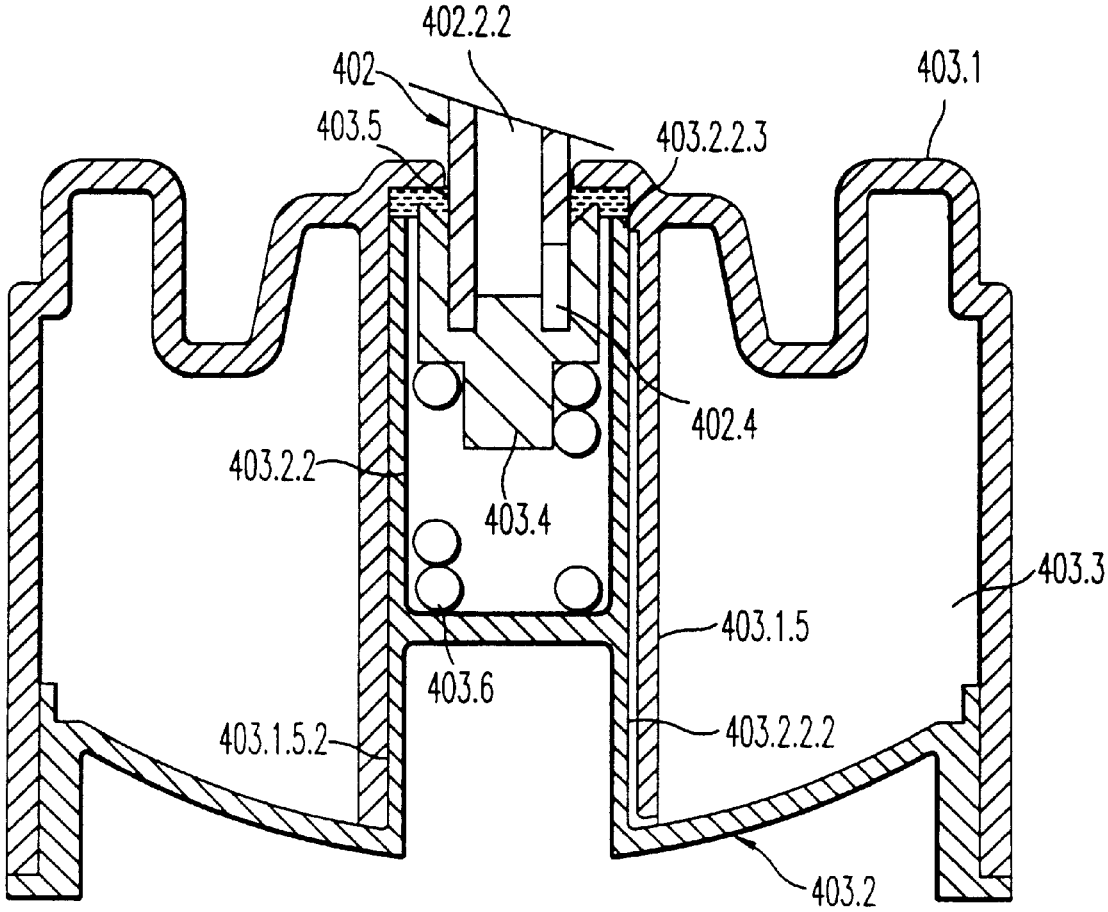
FIG. 4 is a view in longitudinal section of another embodiment for a pressurized container according to the present invention, equipped with a female valve.

The container represented in FIG. 4 includes a dished part 403.1 and a valve body 403.2, a spring 403.6, a seal 403.5 and a valve-control stem 403.4.

For purposes of simplification, the cap is not represented, and the end of the push-button 402 interacting with the valve-control stem is simply represented. This container can be distinguished from those represented in the preceding figures: by its valve-control stem 403.4 which is of the female type, and in which the end of the push-button 402 will be inserted; by the fact that the groove 403.2.2.2 is cut from the interior face of the internal skirt 403.1.5 of the dished part and not from the internal skirt 403.2.2 of the valve body. When the user exerts pressure on the stem 403.4, via the push-button 402, the end of the duct 402.2.2 of the push-button 402 pushes the valve stem 403.2 downwards, which breaks the seal between the valve stem 403.4 and the seal 403.5. The product can then pass from the cavity 403.3 to the dispensing duct 402.2.2 via the duct 403.2.2.2, the notch 403.2.2.3, a slot 402.4 made at the end of the push-button 402 and the chamfer 403.1.5.2. As far as the user is concerned, the operation of this container is the same as that of the preceding containers.

Figure 5:
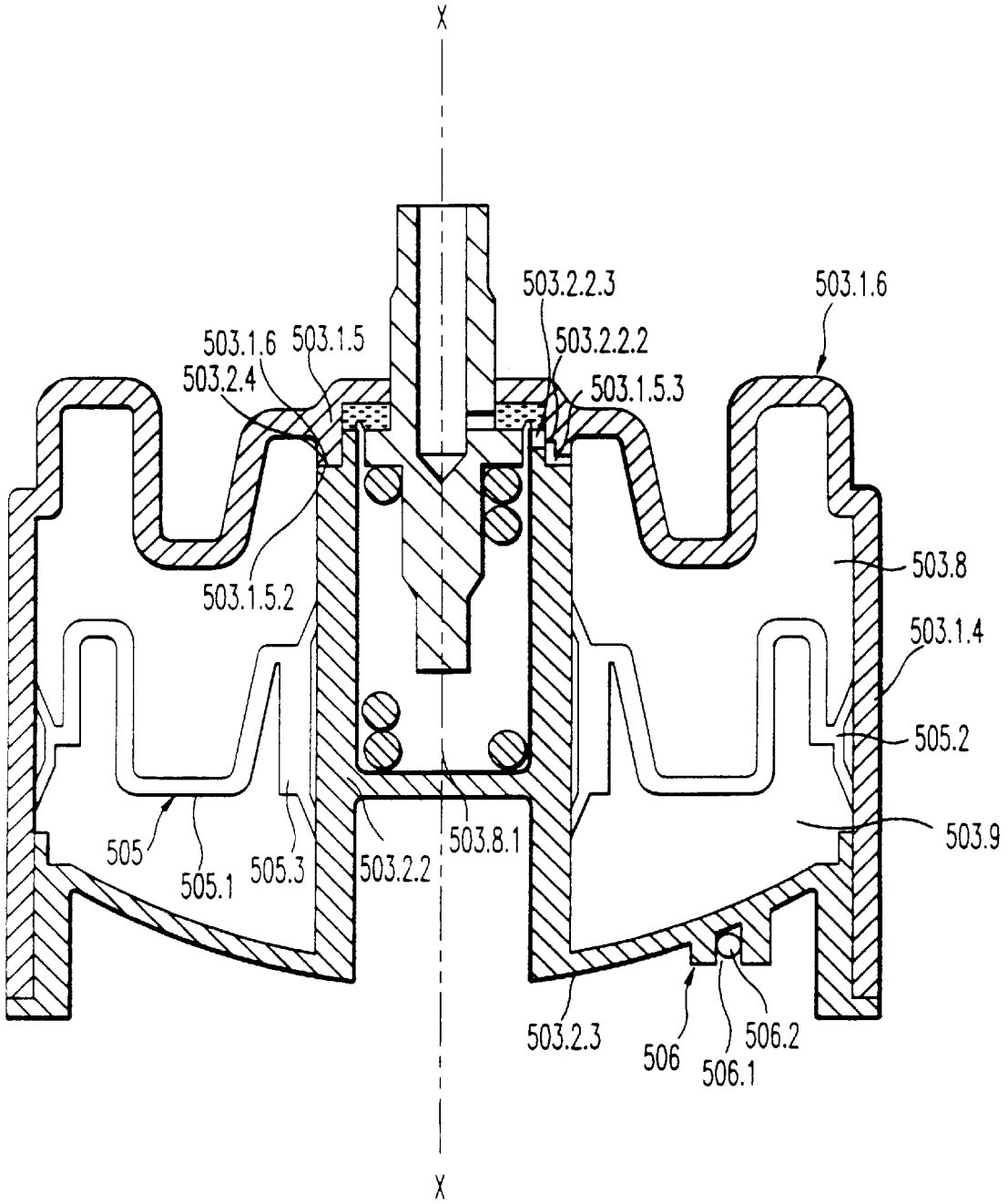
FIGS. 5 and 6 are views in longitudinal section of aerosol cans according to the present invention, the reservoir cavity of which is divided in two by a piston.

The container represented in FIG. 5 can be distinguished from the one in FIG. 1 by the relative arrangement of the internal skirts of the dished part 503.1.5 and of the valve body 503.2.2, by the presence of a piston 505 and of a ball-type filling orifice 506.

In this container, the internal skirt of the valve body 503.2.2 has a height substantially equivalent to that of the cavity 503.8.1 of the valve and has a shoulder 503.1.6 on its upper edge, against which shoulder the lower edge 503.2.4 of the internal skirt 503.1.5 of the dished part comes to rest. A passage is formed between the cavity 503.8, able to contain the product, and the valve cavity 503.8.1 by cutting out a notch 503.2.2.3 in the internal skirt of the valve body and, facing this notch, cutting a notch 503.1.5.3, a chamfer 503.1.5.2 and a groove 503.2.2.2 in the internal skirt of the dished part.

The annular piston 505 separates the reservoir cavity into two cavities: one, 503.8 capable of containing the product, and the other, 503.9, capable of containing the gas. The piston 505 is equipped at its ends with means 505.2 and 505.3 of the sealing lip type allowing it to be positioned in a leaktight manner on the external skirt 503.1.4 of the dished part and on the internal skirt 503.2.2 of the valve body respectively. This means prevents the gas and product from mixing. The piston can move and travel along a vertical axis (X-X) passing through the valve-control stem, while remaining positioned against the two skirts.

The piston 505 is further equipped with a profile 505.1 allowing it to match the internal wall of the upper plate 503.1.6 of the dished part so that the cavity 503.8 can be emptied as completely as possible as this piston moves towards the upper part of the container, as it is used, under the pressure of the gas.

The ball orifice 506 consists of a cylindrical orifice 506.1 and of a ball 506.2, with a diameter larger than that of the orifice so that when the ball is pushed forcibly into the orifice, it closes it in a leaktight manner. This ball orifice 506 is placed in the bottom 503.2.3 of the valve body.

Before the container of FIG. 5 is filled, the piston is pressed against the dished part. The product is introduced into the cavity 503.8 in the same way as in the container of FIG. 1 (via the valve-control stem). The gas is introduced via the orifice 506.1 then the latter is closed by the ball 506.2 which is pushed in forcibly.

Figure 6:
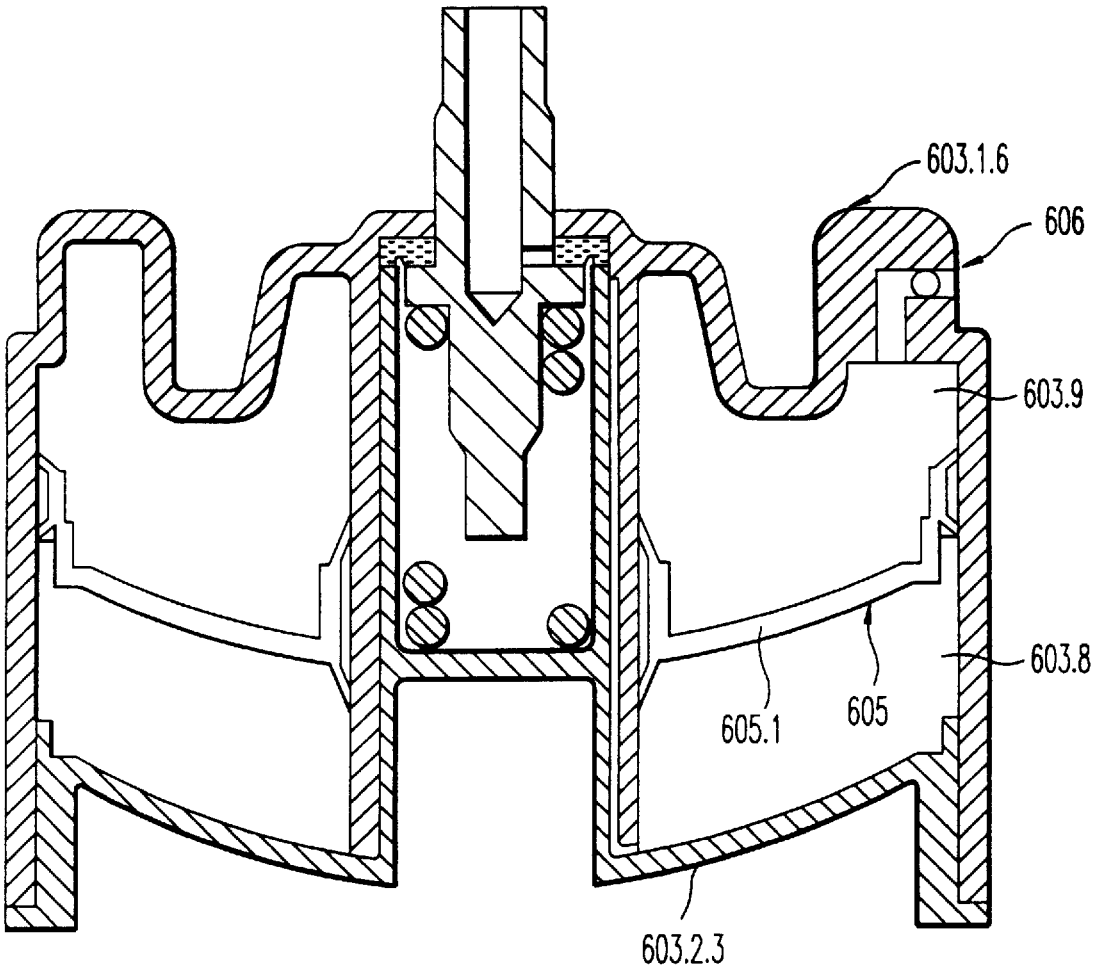

The container represented in FIG. 6 can be distinguished from that of FIG. 1 by the presence of an annular piston 605 in the reservoir cavity, which partitions the latter into a product cavity 603.8 in its lower part and a cavity 603.9 able to contain the gas in its upper part. The arrangement of the piston is the inverse of that of FIG. 5: the profile 605.1 of the piston is designed to match the internal profile 603.2.3 of the bottom 603.2.3 of the valve body. The ball orifice 606 is situated in the upper part of the dished part, so as to allow the cavity 603.9 to be filled with gas. During assembly, the piston 605 is placed against the bottom 603.2.3 of the valve body, then the product is introduced into the cavity 603.8 via the valve, as in the other containers and the compressed gas is introduced via the ball orifice 606 before this orifice is closed.

Figure 7:
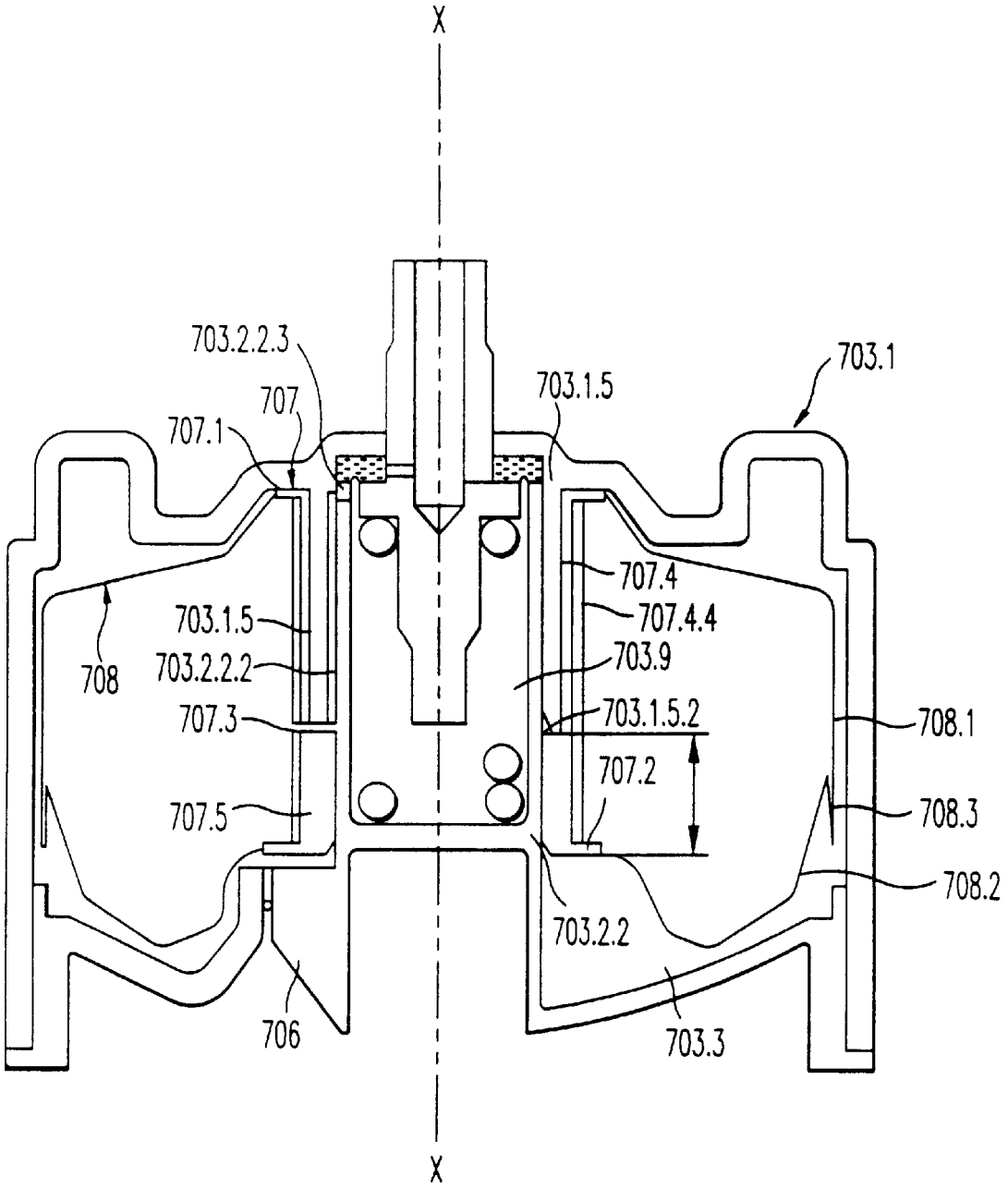
FIG. 7 is a view in longitudinal section of a pressurized container according to the present invention, the reservoir cavity of which is divided in two by a bag mounted on a spool.

The container represented in FIG. 7 can be distinguished from that of FIG. 1 by the presence of a deformable bag 708 fixed to a cylindrical spool 707 in the reservoir cavity 703.3, with the same axis X-X as the internal skirt of the valve body 703.2.2 and of the dished part 703.1.5, by the altered arrangement of the skirt 703.1.5 of the dished part 703.1 and by the presence of a ball orifice 706 in the valve body.

The skirt 703.1.5 of the dished part is of a height which is less than that of the reservoir cavity 703.3.

The cylindrical spool 707 in its lower part 707.5 has an inside diameter substantially equal to the outside diameter of the internal skirt 703.2.2 of the valve body, so that the internal skirt of the valve body is placed inside the spool and is in sealed contact therewith over its entire lower part 707.5. Over the rest of its height 707.4, the spool has an inside diameter equal to the outside diameter of the internal skirt 703.1.5 of the dished part so that in its upper part 707.4, the spool traps in sealed manner the internal skirt 703.1.5 of the dished part, itself slipped around the skirt 703.2.2 of the valve body.

In its upper and lower parts, the spool 707 has two annular regions of welding 707.1 and 707.2 respectively. On its outer surface, the spool 707 has anti-trapping channels 707.4.4. These channels make it possible to avoid some of the product remaining blocked in a part of the bag when the latter is emptying and becoming pressed against the spool.

The bag 708 consists of 2 parallel sheets 708.1 and 708.2 welded together by an annular weld 708.3, and welded to the spool by the regions of welding 707.1 and 707.2. The bag/spool assembly forms a sealed cavity in communication with the valve cavity 703.9 via the opening 707.3, and the chamfer 703.1.5.2 of the spool 707, the groove 703.2.2.2 cut along the entire height of the internal skirt 703.1.5 of the dished part, and the notch 703.2.2.3 on the upper edge of the internal skirt of the valve body.

On assembly, the bag 708 is welded to the spool 707, and the assembly is slipped over the internal skirt of the dished part and then the valve body is positioned and welded to the dished part.

The valve makes it possible, after the entire container has been assembled, to produce a vacuum in the bag 708, then to fill it with product. The gas is introduced into the reservoir cavity 703.3 via the ball orifice 706, before this is closed.

Figure 8A:
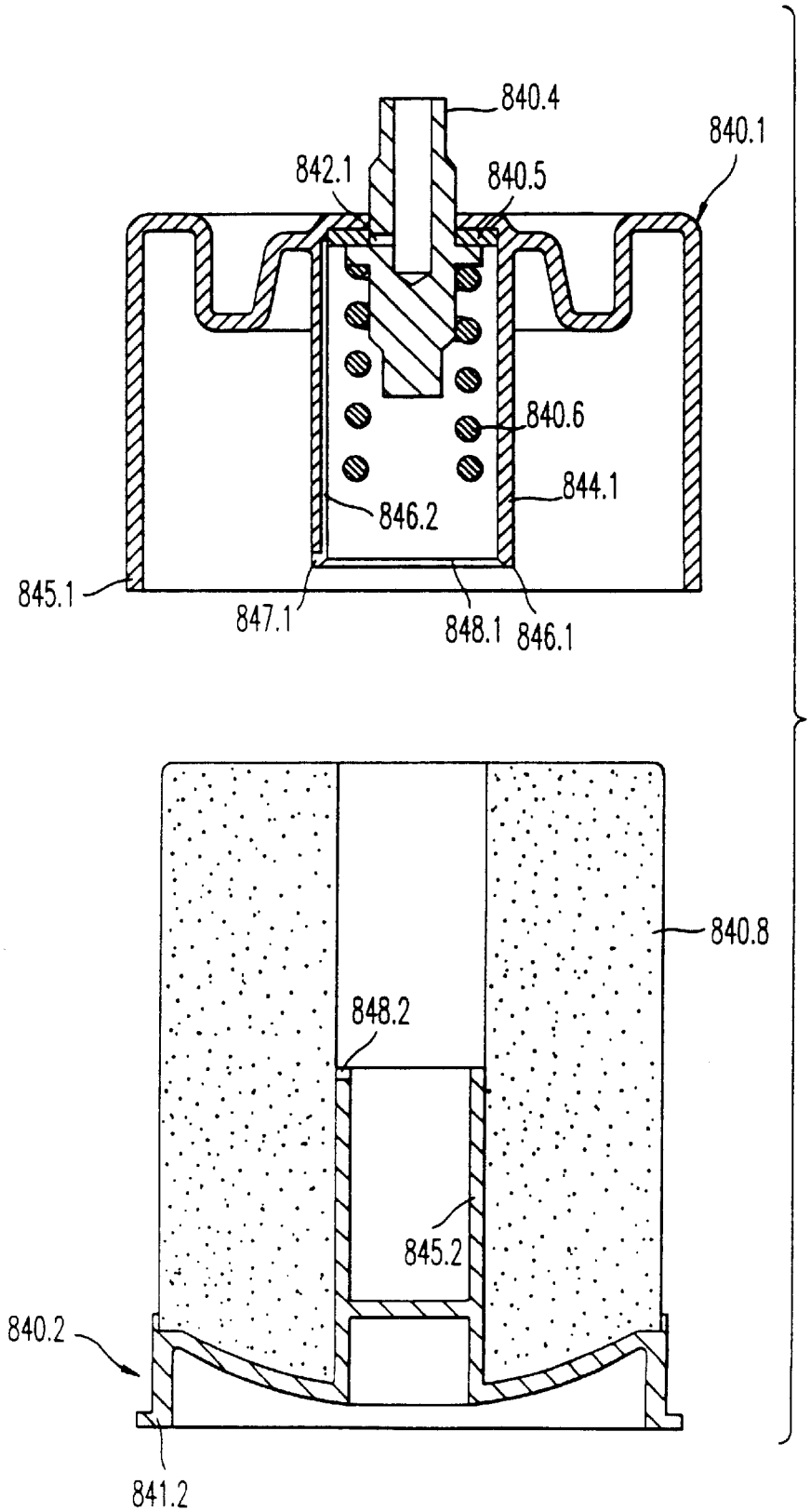
FIGS. 8A to 8C are views in longitudinal section of a pressurized container according to the present invention, the reservoir cavity of which comprises a ring of cellular foam.
Figure 8B:
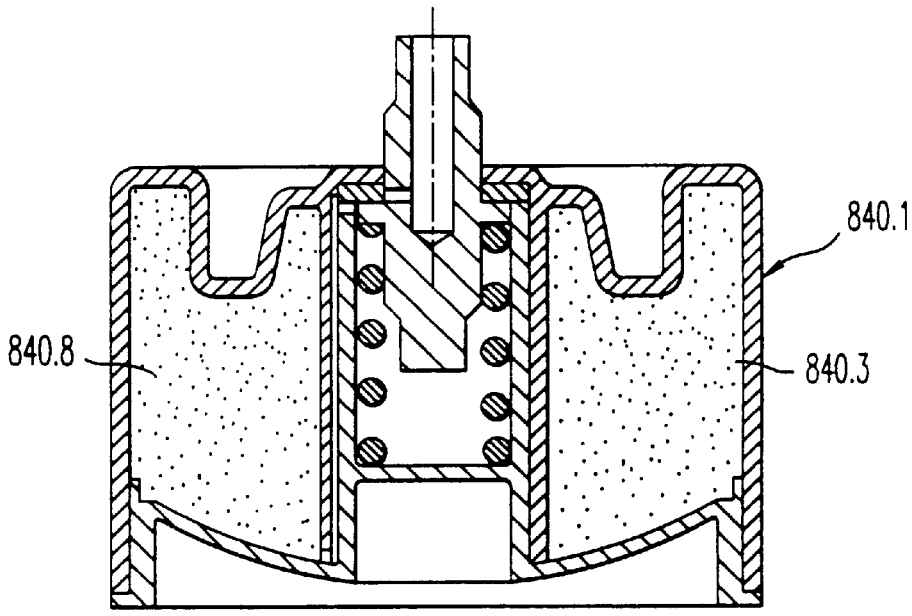
Figure 8C:
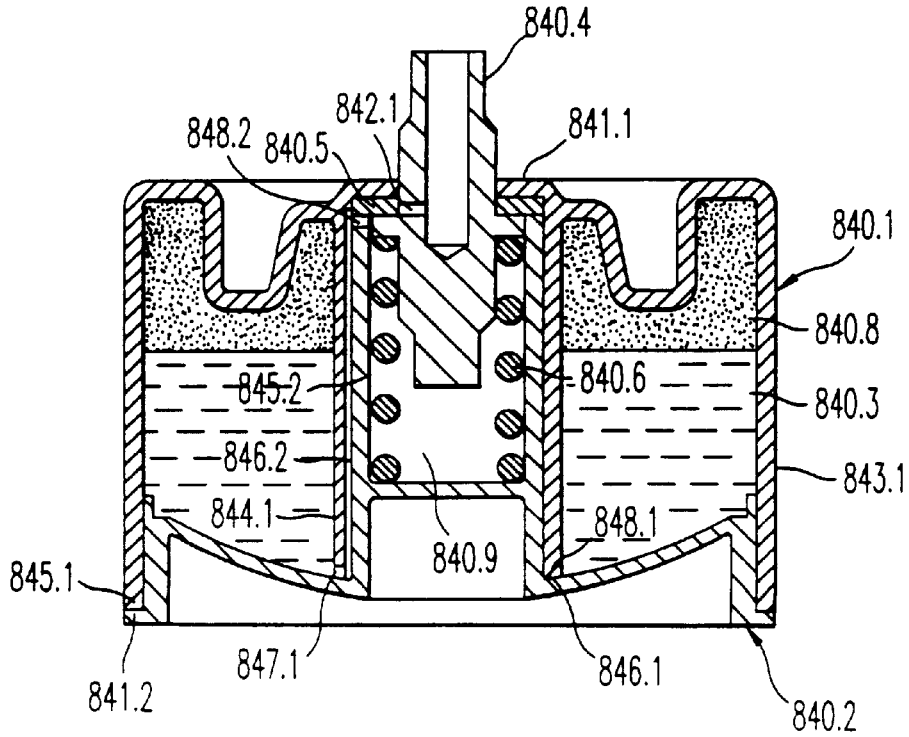

A pressurized container according to FIGS. 8A to 8C, of cylindrical overall shape is composed of a dished part 840.1 onto which is fitted a cap (not represented). This dished part interacts with the valve body 840.2 to form, on the one hand, an annular reservoir cavity 840.3 containing a product 840.7 and in which a ring of cellular material 840.8 as represented in FIG. 11A has been introduced and, on the other hand, the valve cavity 840.9. Inside this there are: an emerging valve-control stem 840.4, a seal 840.5 and a spring 840.6 which, with the valve body, constitute the valve proper. The emerging stem 840.4 is intended to interact with a push-button, not represented.

Among other things, at the center of its upper plate 841.1, the dished part 840.1 has an orifice 842.1 through which the emerging stem 840.4 passes, an outer skirt 843.1 and an inner skirt 844.1, which are coaxial, the plate 841.1 being orientated substantially at right angles to these skirts.

The outer skirt 843.1 in its lower part has a profile 845.1 capable of accommodating a complementary profile 841.2 coming from the valve body 840.2; these two profiles are welded (FIG. 8C).

The inner skirt 844.1 of the dished part has an inside diameter corresponding substantially to that of the seal 840.5 and a height substantially identical to that of the cavity 840.3. The lower surface 846.1 of the inner skirt of the dished part is welded to the bottom of the valve body (FIG. 8C). Situated on the internal periphery of the skirt 844.1 is a chamfer 848.1. A notch 847.1 is furthermore provided in the internal periphery of the bottom of the skirt 844.1; this notch breaks up the continuity of the weld between the internal skirt and the valve body.

The valve body 840.2 on its circumference has the profile 841.2 which complements the one already described 845.1; this profile allows the valve body and the dished part to be centered during assembly and is welded to the part 845.1 of the dished part. The valve body has an inner skirt 845.2, the outside diameter of which is substantially equal to the inside diameter of the inner skirt 844.1 of the dished part and these two elements are welded. A groove 846.2 is provided on the outer lateral face of this skirt 845.2, over its entire height, and a notch 848.2 is situated on the upper edge of this skirt.

The assembling of the pressurized container as represented in FIG. 8C is represented in FIGS. 8A and 8B: first of all the spring 840.6 is assembled around the emerging stem 840.4, then the seal 840.5 is placed in the space defined by the inner skirt of the valve body; next, the ring 840.8 and the dished part 840.1 are positioned and the dished part is welded to the valve body 840.2 at the skirt ends.

The pressurized container is then filled through the valve: by depressing the emerging stem 840.4 the product, under pressure, fills the first cavity 840.9 defined by the inner skirt of the valve body, passes through the notch 848.2, runs down along the groove 846.2, via the chamfer 848.1 then via the notch 847.1 and fills the cavity 840.3.

A push-button and a cap which are not represented can then be fitted over the emerging stem and onto the dished part respectively.

When the emerging stem is depressed via the push-button, the product follows the reverse path to the one described for filling the device.

Upon injection of the product, the ring is still compressed when the product reaches the orifices 847.1 situated at the bottom of the cavity 840.3, and the ring is pushed back upwards. It follows that the container thus formed can operate in a number of positions. Vertical anti-trapping channels may be provided along the internal wall of the outer skirt 843.1 of the dished part, these channels making it possible to use up the product better.

Represented in FIGS. 9A and 9B, respectively, are a pressurized container and a set of pressurized containers including a first container 90*a*, a second container 90*b* and a third container 90*c* which are in accordance with FIG. 1. Of course, this stack may be produced using containers from the other figures. The bottom of the valve body 93.2 of the container has a cavity 93.2.4 into which a complementary cylindrical stud 91.1 situated on the cap 91 of another container will fit in order to secure two containers together.

For example, the bottom of the valve body 93.2*a*, 93.2*b* of the containers represented in FIG. 9B has a cavity 93.2.4*a*, 93.2.4*b* respectively, into which there fits a complementary cylindrical stud 91.1*b*, 91.1*c* respectively situated on the cap 91*b*, 91*c* of another container so as to secure two containers together.

The device represented in FIGS. 10A and 11B includes a container body 101 onto which a cap (not represented) may possibly be fitted; crimped to the neck of this container via a valve-holder dished part 103 is a valve 102; the container body and the dished part define a reservoir cavity 101.1; the valve consists of a valve body 102.1, of a valve-control stem 102.2 which passes through the valve body, of a seal 102.3 and of a spring 102.4 which presses the valve-control stem 102.2 against the seal 102.3, the assembly being held in place by the crimping of the valve-holder dished part 103. A dip tube 107 is fixed to the valve. Before the valve 102 is crimped to the container body 101, a cylinder 105 made of Plastazote: a matrix made of polyolefin and nitrogen, was introduced into the cavity 101.1, through the opening in the container body 101.

Visible in FIG. 11A is the element 125 made of cellular material, of cylindrical shape, including a cylindrical orifice 126 at its center, before it is introduced into the reservoir cavity of the device.

Visible in FIG. 12A is a solid element 135 made of cellular material and of cylindrical shape which can be used in place of the cylinder 125 in a device according to the invention which does not have a dip member.

Visible in FIG. 10A is the cylinder 105 made of closed-cell cellular material which has been introduced into the reservoir cavity 101.1 of the container body 101. The outside diameter of the cylinder 105 is designed to be greater than the inside diameter of the container body 101, so as to obtain lateral precompression of the element made of cellular material with the purpose of still having energy available for the last remains of product. A cylindrical central orifice 106 is provided in the cylinder 105, the dip tube 107 being housed in this orifice.

For elements of FIG. 10B which are common with FIG. 10A, the reference of FIG. 10A increased by 10 has been used. For elements of FIG. 11C which are common with FIG. 11B, the reference of FIG. 11B increased by 10 has been used.

Represented in FIGS. 10B and 11C is a device according to the invention ready for use: this device can be distinguished from that represented in FIGS. 10A and 11B by the fact that a product 119 has been forcibly introduced through the valve 112, and this has led to lateral and longitudinal compression of the cylinder of cellular material 115. The compression is of the hydraulic type, that is to say in three dimensions, throughout the volume of the element made of cellular material 115. The inside diameter of the orifice 116 is therefore slightly increased by comparison with the diameter of the orifice 106 represented in FIG. 10A. The cylinder of cellular material 115 is therefore free to move along the dip tube 117 as a function of its relative density by comparison with the product. Placed on the valve-control stem 112.2 is a push-button 114. By actuating the push-button 114, the valve 112 is opened, the cylinder 115 expands and expels the product 119. When all the product 119 has been expelled from the device, the latter finds itself back in the configuration represented in FIGS. 10A and 11B. This device can be refilled with product 119 as described hereinabove. A saving in packaging is thus made, and the problem of reprocessing pressurized devices is considerably reduced because one and the same device can be reused a great many times.

Figure 12B:
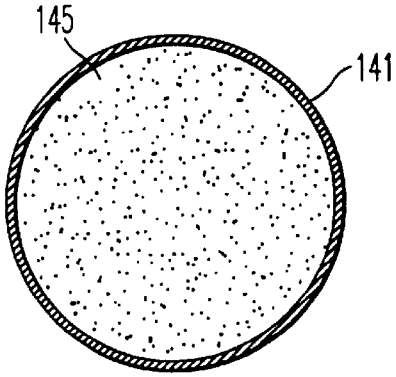
Figure 12C:
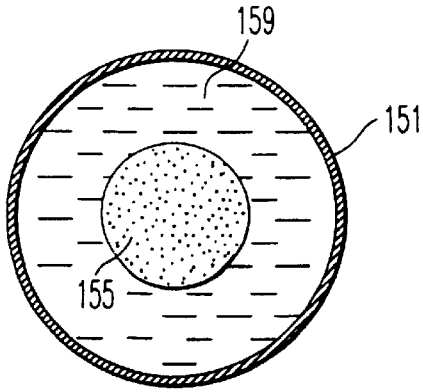

The alternative form of the device according to the present invention represented in FIGS. 12A, 12B and 12C can be distinguished from the device represented in FIGS. 10A, 10B and 11A, 11B and 11C by the absence of a dip tube and of a central orifice in the cylinder of cellular material. Visible in FIG. 12B is the cylinder of cellular material 145 which is placed in the container 141, then in FIG. 12C this same cylinder 155 can be seen compressed hydraulically inside the container 151 into which the product 159 has been introduced.

Having now described the present invention, it will be readily apparent that many changes and modifications may be made to be embodiments described herein without departing from the object and the scope of the present invention.

What is claimed as new and is desired to be secured by Letters Patent of the of the United States is:

1. A dispenser for a pressurized product, the dispenser comprising:

an upper element;

a lower element, the upper element and the lower element being configured to cooperate together so that both the upper element and the lower element form a reservoir for containing a pressurized product, and a valve cavity; and a valve including the valve cavity formed by the upper and lower elements, an inlet passage for providing flow of the pressurized product from the reservoir to the valve, an outlet passage for providing flow of the pressurized product from the valve to a dispensing outlet of the dispenser, and a movable valving member configured to be moved from a closed position to an open position to enable flow of the pressurized product through the dispensing outlet.

2. The dispenser of claim 1, further comprising an element made of closed-cell cellular material, the cellular material element being located in the reservoir and configured such that the cellular material element applies pressure to a product when the reservoir is filled with the product.

3. The dispenser of claim 2, wherein the cellular material includes a foam material chosen from materials made of polyolefin, elastomer, thermoplastic, rubber, Buna, neoprene and silicone.

4. The dispenser of claim 2, wherein the cellular material element has a shape substantially the same as a shape of the reservoir.

5. The dispenser of claim 2, wherein the cellular material element has a cylindrical overall shape.

6. The dispenser of claim 2, wherein the cellular material element has a central orifice.

7. The dispenser of claim 2, wherein the cellular material element is formed by extrusion.

8. The dispenser of claim 2, wherein the cellular material element has dimensions larger than those of the reservoir, before the cellular material element is disposed in the reservoir.

9. The dispenser of claim 1, further comprising product contained in the reservoir, wherein the product is in the form of a solution, emulsion or gel.

10. The dispenser of claim 1, further comprising product contained in the reservoir, wherein the product is selected from the group consisting of lotions, creams, self-foaming compositions, milks, and gels.

11. The dispenser of claim 1, wherein the upper and lower elements are made of polybutylene terephthalate.

12. The dispenser of claim 1, wherein the valve cavity is formed in part by the lower element.

13. The dispenser of claim 12, wherein both the reservoir and the valve cavity are defined in part by the upper element and by the lower element.

14. The dispenser of claim 1, wherein the valving member comprises a stem disposed in the valve cavity.

15. The dispenser of claim 14, wherein a portion of the stem extends from the valve cavity.

16. The dispenser of claim 1, wherein valving member comprises a female member.

17. The dispenser of claim 1, further comprising a movable actuator coupled to the valving member so that actuating movement of the actuator actuates the valving member to the open position.

18. The dispenser of claim 17, wherein the movable actuator is in the form of a push button.

19. The dispenser of claim 18, wherein the upper element includes a channel on a top portion thereof and wherein the actuator includes a skirt, the skirt being configured to be placed in the channel during actuating movement of the actuator.

20. The dispenser of claim 1, wherein the valve further includes a biasing member biasing the valving member toward the closed position.

21. The dispenser of claim 20, wherein the biasing member is a spring disposed in the valve cavity.

22. The dispenser of claim 1, wherein the valve further comprises a seal cooperating with the valving member to prevent flow of the pressurized product from the valve when the valving member is in the closed position.

23. The dispenser of claim 1, wherein the valving member is movable in one of a first direction along a longitudinal axis of the dispenser and a second direction lateral to the first direction.

24. The dispenser of claim 1, wherein the upper element comprises a first axially oriented annular wall and lower element comprises a second axially oriented annular wall, an outer diameter of the second wall being slightly less than an inner diameter of the first wall so that the second wall fits inside the first wall.

25. The dispenser of claim 24, wherein the inlet passage of the valve is defined between the first and second walls.

26. The dispenser of claim 1, wherein the inlet passage is configured so that the pressurized product can be dispensed in head-up position of the dispenser wherein the upper element is oriented above the lower element.

27. The dispenser of claim 1, wherein the inlet passage is configured so that the pressurized product can be dispensed in head-down position of the dispenser wherein the upper element is oriented below the lower element.

28. The dispenser of claim 1, wherein the upper element and the lower element are joined together by one of welding, bonding, screwing, and snap-fitting.

29. The dispenser of claim 1, further comprising an orifice for filling the reservoir and a valve element for the orifice.

30. The dispenser of claim 1, further comprising a product in the reservoir and a gas pressurizing the product.

31. The dispenser of claim 30, wherein the gas is contained separately from the product.

32. The dispenser of claim 31, wherein the gas is separated from the product by one of a piston, a flexible bag, and a closed-cell cellular material.

33. The dispenser of claim 30, wherein the product and the gas are contained in the reservoir such that the product and the gas contact one another.

34. The dispenser of claim 1, wherein the upper element and the lower element are made of thermoplastic material.

35. The dispenser of claim 1, wherein the upper element and the lower element are made of the same material.

36. The dispenser of claim 1, wherein the upper element and the lower element are made of two chemically compatible different materials.

37. The dispenser of claim 1, wherein the upper element and the lower element are made of a material chosen from a polyolefin, a polyacetyl, polyethylene terephthalate, polymethylmethacrylate, and polybutylene terephtalate.

38. The dispenser of claim 1, further comprising one of a nozzle, a mesh, and a porous dome disposed in a flow path for the pressurized product.

39. The dispenser of claim 1, wherein the reservoir has a volume ranging from about 3.5 ml to about 8 ml.

40. The dispenser of claim 1, wherein the reservoir has a generally annular shape and wherein the reservoir surrounds the valve cavity.

41. The dispenser of claim 40, wherein the generally annular shape of the reservoir extends from a bottom end of the reservoir to a top end of the reservoir.

42. The dispenser of claim 1, wherein the upper element defines a top end of the valve cavity and wherein the lower element defines a bottom end of the valve cavity.

43. The dispenser of claim 42, wherein the valve further comprises a biasing member biasing the valving member toward the closed position, wherein the biasing member contacts a portion of the lower element defining the bottom end of the valve cavity.

44. The dispenser of claim 42, wherein the upper element defines a top end of the reservoir and wherein the lower element defines a bottom end of the reservoir.

45. The dispenser of claim 44, wherein a portion of the lower element defining the bottom end of the reservoir has an inward-sloping concave profile.

46. The dispenser of claim 44, wherein the upper element includes an outer skirt defining an outer portion of the reservoir and an inner skirt defining an inner portion of the reservoir.

47. The dispenser of claim 46, wherein the lower element has an inner skirt defining a side portion of the valve cavity.

48. The dispenser of claim 47, wherein the inner skirt of the lower element is disposed within the inner skirt of the upper element.

49. The dispenser of claim 48, wherein at least one of the inner skirt of the lower element and the inner skirt of the upper element are configured to define the inlet passage of the valve.

50. The dispenser of claim 1, wherein the upper element defines a top end of the reservoir and wherein the lower element defines a bottom end of the reservoir.

51. The dispenser of claim 50, wherein a portion of the lower element defining the bottom end of the reservoir has an inward-sloping concave profile.

52. The dispenser of claim 1, wherein the valve further comprises a seal contacting the upper element and the lower element.

53. The dispenser of claim 52, wherein the valving member comprises a stem, and wherein the seal is configured to encircle the stem.

54. The dispenser of claim 1, wherein the valving member defines the outlet passage.

55. The dispenser of claim 1, wherein the upper element has a dished shape.

56. The dispenser of claim 1, further comprising a cap configured to fit on the upper element, a first coupling member provided on the cap and a second coupling member provided on the lower element, the first and second coupling elements being configured to be coupled together.

57. The dispenser of claim 56, wherein the first coupling member is a cylindrical stud and wherein the second coupling member is a cavity configured to receive the stud in frictional engagement.

58. A set of dispensers comprising:

a plurality of dispensers each configured like the dispenser of claim 56, wherein at least two of the dispenser are capable of being coupled together by coupling a first coupling member of one dispenser to a second coupling member of another dispenser.

59. A dispenser for a pressurized product, the dispenser comprising:

a dispensing outlet on an upper portion of the dispenser;

an upper element;

a lower element, the upper element and the lower element both defining a reservoir for containing a pressurized product; and a valve including a movable valving member configured to be moved from a closed position to an open position to enable flow of the pressurized product through the dispensing outlet, and a biasing member biasing the valving member toward the closed position, the biasing member being in contact with the lower element.

60. The dispenser of claim 59, wherein the biasing member biases the valving member toward the upper portion of the dispenser.

61. The dispenser of claim 59, wherein the valve includes a valve cavity having a bottom end defined by the lower element, and wherein the biasing member contacts a portion of the lower element defining the bottom end.

62. The dispenser of claim 59, wherein the valving member comprises a stem.

63. The dispenser of claim 59, further comprising a movable actuator coupled to the valving member so that actuating movement of the actuator actuates the valving member to the open position.

64. The dispenser of claim 63, wherein the movable actuator is in the form of a push button.

65. The dispenser of claim 59, wherein the biasing member is a spring.

66. The dispenser of claim 59, wherein the valve further comprises a seal cooperating with the valving member to prevent flow of the pressurized product from the valve when the valving member is in the closed position.

67. The dispenser of claim 59, wherein the valving member is movable in one of a first direction along a longitudinal axis of the dispenser and a second direction lateral to the first direction.

68. The dispenser of claim 59, wherein the upper element comprises a first axially oriented annular wall and the lower element comprises a second axially oriented annular wall, an outer diameter of the second wall being slightly less than an inner diameter of the first wall so that the second wall fits inside the first wall.

69. The dispenser of claim 59, further comprising a product in the reservoir and a gas pressurizing the product.

70. The dispenser of claim 59, wherein the reservoir has a generally annular shape extending from a bottom end of the reservoir to a top end of the reservoir.

71. The dispenser of claim 59, wherein the upper element defines a top end of the reservoir and wherein the lower element defines a bottom end of the reservoir.

72. The dispenser of claim 71, wherein the upper element includes an outer skirt defining an outer portion of the reservoir and an inner skirt defining an inner portion of the reservoir.

73. The dispenser of claim 72, wherein the lower element has an inner skirt disposed within the inner skirt of the upper element.

74. The dispenser of claim 73, wherein at least one of the inner skirt of the lower element and the inner skirt of the upper element are configured to define an inlet passage of the valve.

75. The dispenser of claim 71, wherein a portion of the lower element defining the bottom end of the reservoir has an inward-sloping concave profile.

76. The dispenser of claim 59, wherein the upper element has a dished shape.

77. A dispenser for a pressurized product, the dispenser comprising:

a reservoir for containing a pressurized product; and a valve including a valve cavity, an inlet passage in fluid communication with the reservoir, the inlet passage having a first end in fluid communication with the valve cavity and a second end in a vicinity of a bottom of the reservoir, the inlet passage extending outside of the valve cavity along at least a part of the length of the valve cavity, an outlet passage for providing flow of the pressurized product from the valve to a dispensing outlet of the dispenser, and a movable valving member configured to be moved from a closed position to an open position to enable flow of the pressurized product through the dispensing outlet.

78. The dispenser of claim 77, wherein the valving member comprises a stem.

79. The dispenser of claim 77, further comprising a movable actuator coupled to the valving member so that actuating movement of the actuator actuates the valving member to the open position.

80. The dispenser of claim 79, wherein the movable actuator is in the form of a push button.

81. The dispenser of claim 77, wherein the valve further comprises a biasing member and a seal cooperating with the valving member to prevent flow of the pressurized product from the valve when the valving member is in the closed position.

82. The dispenser of claim 77, wherein the valving member is movable in one of a first direction along a longitudinal axis of the dispenser and a second direction lateral to the first direction.

83. The dispenser of claim 77, wherein the dispenser further comprises a first axially oriented annular wall and a second axially oriented annular wall within the first wall, and wherein at least a portion of the inlet passage is between the first and second walls.

84. The dispenser of claim 83, wherein a side of the valve cavity is defined by the second wall.

85. The dispenser of claim 77, further comprising a product in the reservoir and a gas pressurizing the product.

86. The dispenser of claim 77, wherein the reservoir has a generally annular shape extending from a bottom end of the reservoir to a top end of the reservoir.

87. The dispenser of claim 77, wherein a portion of the dispenser defining a bottom end of the reservoir has an inward-sloping concave profile.

88. The dispenser of claim 77, wherein the valving member defines the outlet passage.

89. The dispenser of claim 77, further comprising an upper element and a lower element cooperating to define both the reservoir and the valve cavity.

90. A dispenser for a pressurized product, the dispenser comprising:

a container body including at least one inner wall and an outer wall defining a reservoir for containing a pressurized product, the reservoir having a generally annular shape extending from a bottom end of the reservoir to a top end of the reservoir;

a valve including a valve cavity located in the container body such that the generally annular reservoir surrounds the valve cavity and a top end of the valve cavity is in a vicinity of the top end of the reservoir, an inlet passage for providing flow of the pressurized product from the reservoir to the valve, an outlet passage for providing flow of the pressurized product from the valve to a dispensing outlet of the dispenser, and a movable valving member configured to be moved from a closed position to an open position to enable flow of the pressurized product through the dispensing outlet.

91. The dispenser of claim 90, wherein the top end of the reservoir and the top end of the valve cavity are at substantially the same level.

92. The dispenser of claim 90, wherein the container body comprises an upper element having a top portion defining both the top end of the reservoir and the top end of the valve cavity.

93. The dispenser of claim 91, wherein the container body comprises a lower element having a bottom portion defining both a bottom end of the reservoir and a bottom end of the valve cavity.

94. The dispenser of claim 91, wherein the valving member comprises a stem.

95. The dispenser of claim 91, comprising a movable actuator coupled to the valving member so that actuating movement of the actuator actuates the valving member to the open position.

96. The dispenser of claim 91, wherein the movable actuator is in the form of a push button.

97. The dispenser of claim 91, wherein the valve further comprises a biasing member and a seal cooperating with the valving member to prevent flow of the pressurized product from the valve when the valving member is in the closed position.

98. The dispenser of claim 91, wherein the valving member is movable in one of a first direction along a longitudinal axis of the dispenser and a second direction lateral to the first direction.

99. The dispenser of claim 90, wherein the container body comprises a first axially oriented annular wall and a second axially oriented annular wall within the first wall, wherein the first wall defines an inner portion of the reservoir and the second wall defines a side portion of the valve cavity.

100. The dispenser of claim 99, wherein the inlet passage is defined between the first and second walls.

101. The dispenser of claim 90, further comprising a product in the reservoir and a gas pressurizing the product.

102. The dispenser of claim 90, wherein the valving member defines the outlet passage.

103. The dispenser of claim 90, wherein the container body comprises an upper element and a lower element cooperating to define both the reservoir and the valve cavity.

104. A dispenser for a pressurized product, the dispenser comprising:

a dispensing outlet on an upper portion of the dispenser;

a container body defining a reservoir for containing a pressurized product, the container body including an element defining both a bottom end portion of the reservoir, and a bottom end portion of a valve cavity; and a valve including the valve cavity having the bottom portion defined by the element, an inlet passage for providing flow of the pressurized product from the reservoir to the valve, an outlet passage for providing flow of the pressurized product from the valve to the dispensing outlet, and a movable valving member configured to be moved from a closed position to an open position to enable flow of the pressurized product through the dispensing outlet.

105. The dispenser of claim 104, wherein the element defining the bottom end portions of the reservoir and the valve cavity is a lower element, and wherein the container body further comprises an upper element defining both a top end portion of the reservoir and a top end portion of the valve cavity.

106. The dispenser of claim 104, wherein the element further defines a side portion of the valve cavity.

107. The dispenser of claim 104, wherein the element includes an axially oriented annular wall defining the side portion of the valve cavity.

108. The dispenser of claim 104, wherein the element includes a wall having a first side defining the bottom end portion of the valve cavity and a second opposite-facing side defining an exterior bottom surface of the dispenser.

109. The dispenser of claim 104, wherein the valve further comprises a biasing member biasing the valving member toward the closed position.

110. The dispenser of claim 109, wherein the biasing member is in contact with the element and biases the valving member away from the bottom end portion of the valve cavity.

111. The dispenser of claim 104, wherein the valving member comprises a stem.

112. The dispenser of claim 104, further comprising a movable actuator coupled to the valving member so that actuating movement of the actuator actuates the valving member to the open position.

113. The dispenser of claim 112, wherein the movable actuator is in the form of a push button.

114. The dispenser of claim 104, wherein the valve further includes a seal cooperating with the valving member to prevent flow of the pressurized product from the valve when the valving member is in the closed position.

115. The dispenser of claim 104, wherein the valving member is movable in one of a first direction along a longitudinal axis of the dispenser and a second direction lateral to the first direction.

116. The dispenser of claim 104, further comprising a product in the reservoir and a gas pressurizing the product.

117. The dispenser of claim 104, wherein the valving member defines the outlet passage.

118. The dispenser of claim 104, wherein the reservoir has a generally annular shape and wherein the reservoir surrounds the valve cavity.

119. The dispenser of claim 104, wherein a portion of the element defining the bottom end portion of the reservoir has an inward-sloping concave profile.

120. The dispenser of claim 104, wherein the element further defines an exterior cavity, and wherein the dispenser further comprises a cap having a coupling element configured to be frictional engaged with the exterior cavity.

* * * * *